US010029222B2

(12) United States Patent
Van-De-Velde et al.

(10) Patent No.: US 10,029,222 B2
(45) Date of Patent: Jul. 24, 2018

(54) AGITATOR HAVING SHROUDED VANES FOR SUBMERSIBLE PUMPS

(71) Applicant: Dajustco IP Holdings Inc., Coquitlam (CA)

(72) Inventors: Peter Francis Van-De-Velde, Coquitlam (CA); Nicholas James Guenther, Coquitlam (CA); Timothy Andrew Phillip Gjernes, Coquitlam (CA)

(73) Assignee: DAJUSTCO IP HOLDINGS INC., Coquitlam, British Columbia (CA)

( * ) Notice: Subject to any disclaimer, the term of this patent is extended or adjusted under 35 U.S.C. 154(b) by 0 days.

(21) Appl. No.: 15/631,183

(22) Filed: Jun. 23, 2017

(65) Prior Publication Data

US 2017/0368513 A1 Dec. 28, 2017

Related U.S. Application Data

(60) Provisional application No. 62/353,746, filed on Jun. 23, 2016.

(51) Int. Cl.

| | |
|---|---|
| ***B01F 7/16*** | (2006.01) |
| ***B01F 7/00*** | (2006.01) |
| ***B01F 3/04*** | (2006.01) |
| *F04D 7/04* | (2006.01) |
| *F04D 13/08* | (2006.01) |

(52) U.S. Cl.

CPC ..... *B01F 7/00316* (2013.01); *B01F 3/0478* (2013.01); *B01F 7/1655* (2013.01); *F04D 7/045* (2013.01); *F04D 13/086* (2013.01)

(58) Field of Classification Search

CPC .. B01F 7/00316; B01F 7/1655; B01F 3/0478; F04D 13/086; F04D 7/045

See application file for complete search history.

(56) References Cited

U.S. PATENT DOCUMENTS

| | | | | |
|---|---|---|---|---|
| 3,170,638 | A * | 2/1965 | Burton | B01F 7/005 241/46.17 |
| 3,986,704 | A * | 10/1976 | Risse | B01F 7/00241 366/290 |
| 4,515,482 | A * | 5/1985 | Schadewald | B01F 5/12 366/136 |
| 4,900,159 | A * | 2/1990 | Jamison | B01F 7/005 366/262 |
| 5,407,271 | A * | 4/1995 | Jorgensen | B01F 7/005 241/46.17 |
| 9,782,734 | B2 * | 10/2017 | Heide-Jorgensen | B01F 5/0662 |
| 2016/0107130 | A1 * | 4/2016 | Heide-Jorgensen | B01F 7/00508 366/293 |
| 2017/0368513 | A1 * | 12/2017 | Van-De-Velde | B01F 7/00316 |

* cited by examiner

*Primary Examiner* — Charles Cooley
(74) *Attorney, Agent, or Firm* — Antony C. Edwards

(57) ABSTRACT

An agitator includes a central shaft, a radially spaced array of vanes and a shroud encircling the central shaft so as to intersect the vanes perpendicular to the vanes' depth and along their length, thus defining an inner passageway between the shroud and the central shaft and an outer passageway between the vanes, radially extending outwardly of the shroud.

14 Claims, 8 Drawing Sheets

AGITATOR HAVING SHROUDED VANES FOR SUBMERSIBLE PUMPS

FIELD

The present disclosure relates to an agitator for centrifugal pumps and, more particularly, submersible and cantilever centrifugal pumps.

BACKGROUND

Traditionally, the use of electric submersible pumps (ESPs) in slurries suffers due to the tendency of solid materials within the slurry settling to the bottom of the tank, rather than remaining sufficiently suspended in the fluid in order to be picked up and carried out by the pump. In extreme situations, often encountered for example in steel mills, the use of ESPs in slurry ponds may often necessitate frequent shutdown of the mill's operations while an excavator is moved into the pits to remove the material accumulated at the bottom of the pit. In addition, significant problems with respect to the erosion of mechanical equipment (such as the pumps and the associated agitators) occur when these devices are used to pump thick slurry mixtures, due to abrasive contact between the solids within the slurry and the portions of the mechanical equipment submerged in the slurry. The cause of the erosion is due largely in part to the high abrasiveness of the pumped fluids which contain relatively heavy, solid particulates in the mixture (hereinafter referred to as slurries). In making its way through the pump mechanism, the slurries cause erosion of the impeller blades or vanes (herein referred to interchangeably as blades and vanes), which ultimately leads to wear on the pump mechanism, volute casing and stator of the pump, leading to loss of performance, and possibly subsequent inoperability, of the pump where sustained erosion has occurred. Ongoing wear on the vanes and other portions of the pump may cause significant downtime for repairs and replacements, leading to inefficiencies resulting higher pump maintenance costs and more frequent pump failures or pump repairs.

In many applications, the pumps will be pumping solids that are settled on the floor of a sump. The pump's agitator assists in suspending those solids so they will be picked up for pumping. Thus, agitators are presently known and used to suspend solids in the slurry prior to the slurry being entrained into the impeller, especially where solids have settled out, for example on the floor of a sump. The purpose of an agitator is to mix solids to ensure a mixture containing suspended solids, so that the solids may be pumped through the impeller along with the liquids in which the solids are suspended.

One form of agitator employs vanes mounted below, or otherwise upstream, of the impeller intake, driven from the impeller drive shaft. Thus, rotation of the impeller vanes also rotates the agitator vanes. Conventional agitators of this form, in submersible pumps, use shaft-mounted agitator vanes to force the slurry in which the pump is submersed through the agitator channels between the vanes, as the shaft and vanes are rotated about the shaft's axis of rotation. The rotation of the vanes in the slurry urges the slurry from the agitator channels or passageways so as to agitate the slurry for pumping, while mixing the slurry so as to suspend the solids in the slurry.

As mentioned above, a drawback of pumping slurries containing suspended solids, such as sand, slate and mill scale, is that the suspended solids abrade the agitator vanes. Typical abrasion will, in the Applicant's experience, shorten the life-span of the vanes, for example by thinning the vanes so that they eventually fail and break off of the shaft under load. To extend the life of the vanes, and thereby extend the periods of time the pump may be in service before requiring to be pulled for inspection and servicing, conventionally the vanes are relatively thick and have a restricted depth, measured as the dimension through the vane perpendicular to the axis of rotation of the drive shaft. However, the thicker the vanes and more restricted the depth of the vanes, the less efficient is a set of vanes for agitating a slurry prior to entrainment into the impeller.

Consequently, there exists a need for improved agitator vanes that have an optimal blade shape, for example, optimal curvature and depth so as to optimize volumetric output and velocity of the slurry being pushed downwardly by the agitator.

Applicant is aware of the United States Patent Application No. US 2014/0112755 entitled "Pumps" and U.S. Pat. No. 8,622,706 entitled "Slurry pump having impeller flow elements and a flow directing device", each granted to Burgess. Burgess discloses a pump assembly including a pump impeller, where the impeller includes: a hub, a back shroud extending from the hub, and a front shroud. Each of the shrouds has an inner surface and an outer surface. A plurality of pumping vanes extends between the respective inner surfaces of the shrouds. An impeller inlet opening in the front shroud is coaxial with the rotation axis of the impeller. The impeller includes one or more elements which extend from the inner surface of the front shroud towards the rotation axis and which are positioned adjacent the impeller inlet opening. A flow directing device directs material in relation to the adjacent moving impeller.

In applicant's experience, the pump described by Burgess would not achieve the improved performance of the agitator of the present disclosure, and would not solve the above identified vane wear issues due to abrasion of the vanes. Burgess discloses that the vanes extend between the respective inner surfaces of the shrouds; thus, when the Burgess agitator wears out, the whole impeller needs replacing to replace the agitator.

SUMMARY OF THE DISCLOSED EMBODIMENTS

This disclosure relates to agitators for centrifugal pumps that are used for pumping slurries. The agitator comprises a central shaft, a radially spaced apart array of vanes (or blades, as those terms are used interchangeably herein), extending from the shaft and a shroud encircling the central shaft, wherein the shroud for example is in the shape of a cylinder, and wherein the shroud may intersect the vanes substantially midway along their depth thereby defining inner passageways bounded by the shroud, the central shaft, and the vanes, and outer passageways between the vanes, extending radially outwardly of the shroud.

The shroud in the present disclosure gives additional support to the vanes, and consequently the shroud allows for larger vanes that extend further from the hub and shaft. In the Applicant's experience, vanes which are too large will be more prone to wear and breaking from contact with large solids entrained in the slurry being pumped. The shroud helps strengthen the blades, essentially letting them extend out farther from the hub and shaft. Applicant has observed in experimentation that the shroud wears from abrasion before the inner blades wear very much. It has also been observed that the outer blades wear out first, then the shroud, and then the inner blades, thereby allowing longer operation of the agitator before it must be replaced, as agitation is achieved to some degree even if only the inner blades remain in operation once the outer blades and shroud have been worn away. Thus, the shroud helps improve wear performance of the agitator as the blades will last longer overall. Furthermore, this improved configuration of the agitator employing a shroud promotes an improved flow by enhancing the mixing of the liquids and the solids of the slurry, thereby increasing fluidity of the slurry at the impeller. This effect results in improving the performance and efficiency of the hydraulic pump for removing the slurry from a pit or other container.

BRIEF DESCRIPTION OF THE DRAWINGS

The disclosure will best be understood with reference to and in consideration of, the various illustrative embodiments and processes shown in the accompanying drawings and in the following detailed description thereof.

DETAILED DESCRIPTION OF THE DISCLOSED EMBODIMENTS

Figure 1:
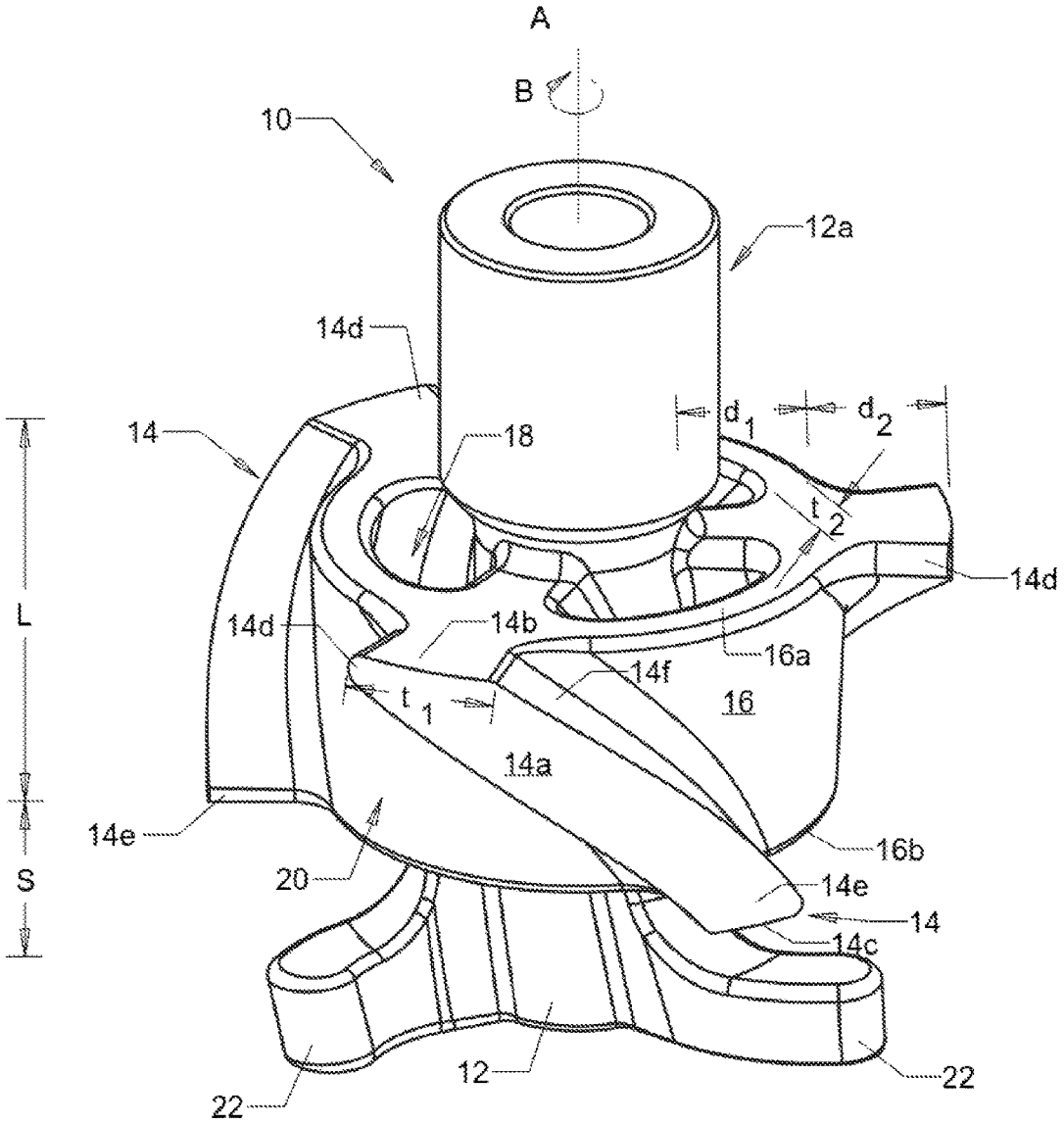
FIG. 1 is a top perspective, side-on view of the agitator according to one embodiment of the disclosure.
Figure 2:
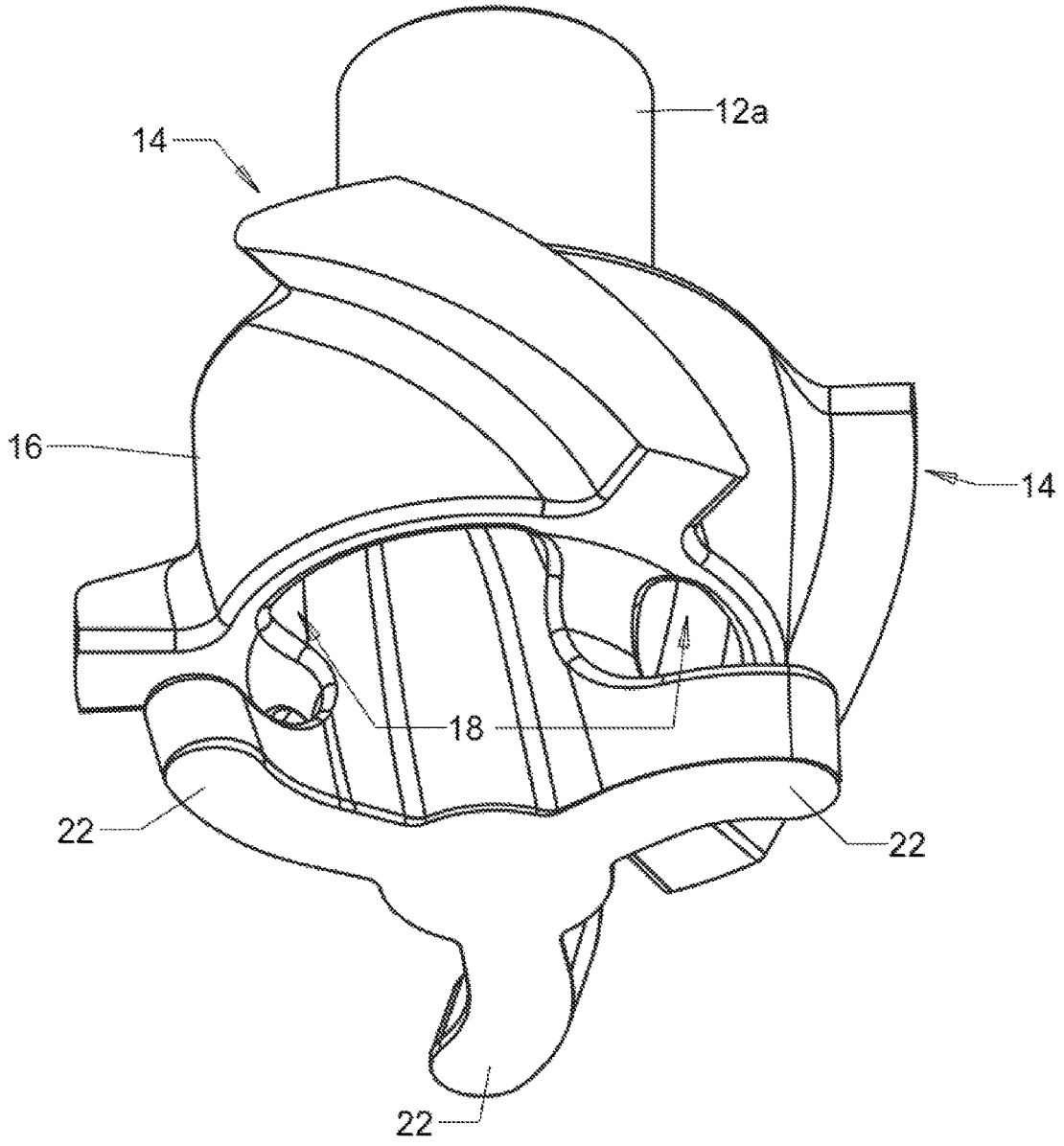
FIG. 2 is an isometric view of the agitator of FIG. 1, showing its lower side.
Figure 3:
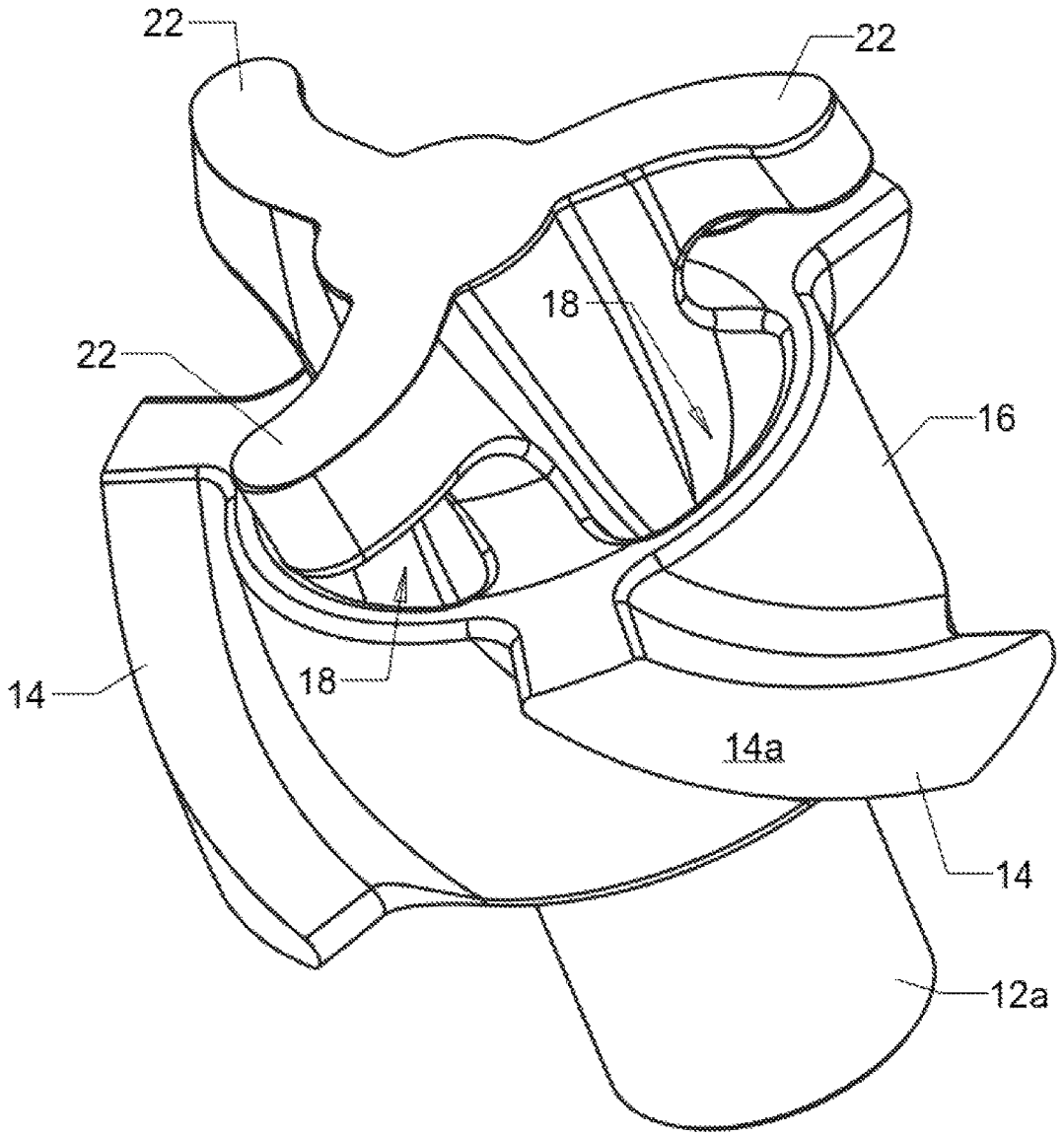
FIG. 3 is a bottom perspective view of the agitator of FIG. 1.

Advantages and objects of the disclosure will become apparent and will be understood by means of the detailed description of the disclosure below, which may be had by reference to the embodiment thereof illustrated in the appended drawings, which form a part of this specification and wherein like reference numerals denote corresponding parts in each view. It is to be noted, however, that the drawings illustrate only one embodiment of the disclosure and therefore are not to be considered limiting of the disclosure's scope as it may admit of other equally effective embodiments.

Thus as illustrated, agitator 10 according to one preferred embodiment of the disclosure includes a central shaft 12 extending along an axis of rotation A, about which the agitator 10 is rotated in direction B. Axis A may advantageously also be an axis of symmetry of agitator 10. A radially spaced array of vanes 14 are radially spaced around the central shaft 12 so as to extend radially outwardly of shaft 12 in a direction substantially perpendicular to axis A.

Figure 4:
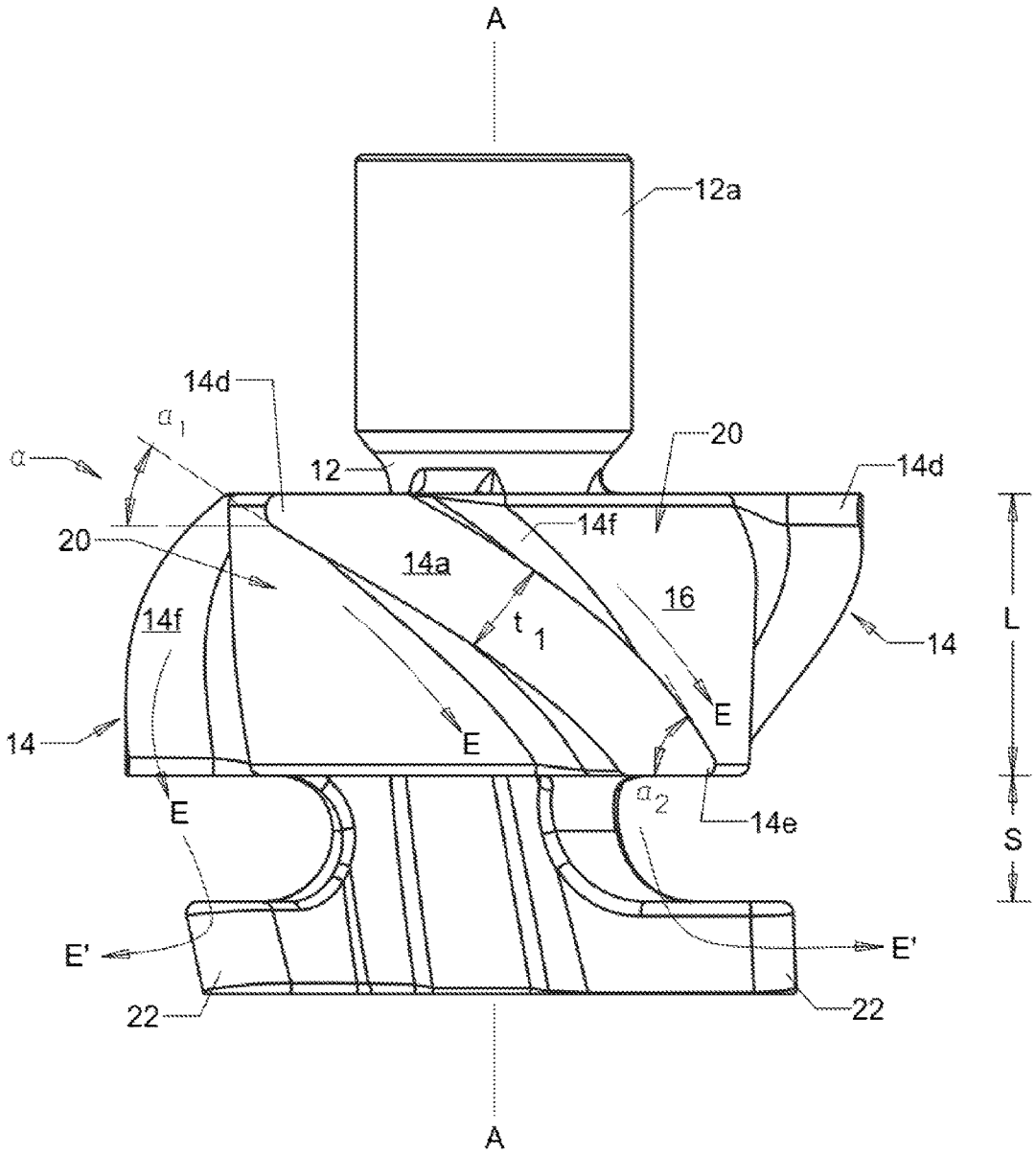
FIG. 4 is a side elevation view of the agitator of FIG. 1.
Figure 5:
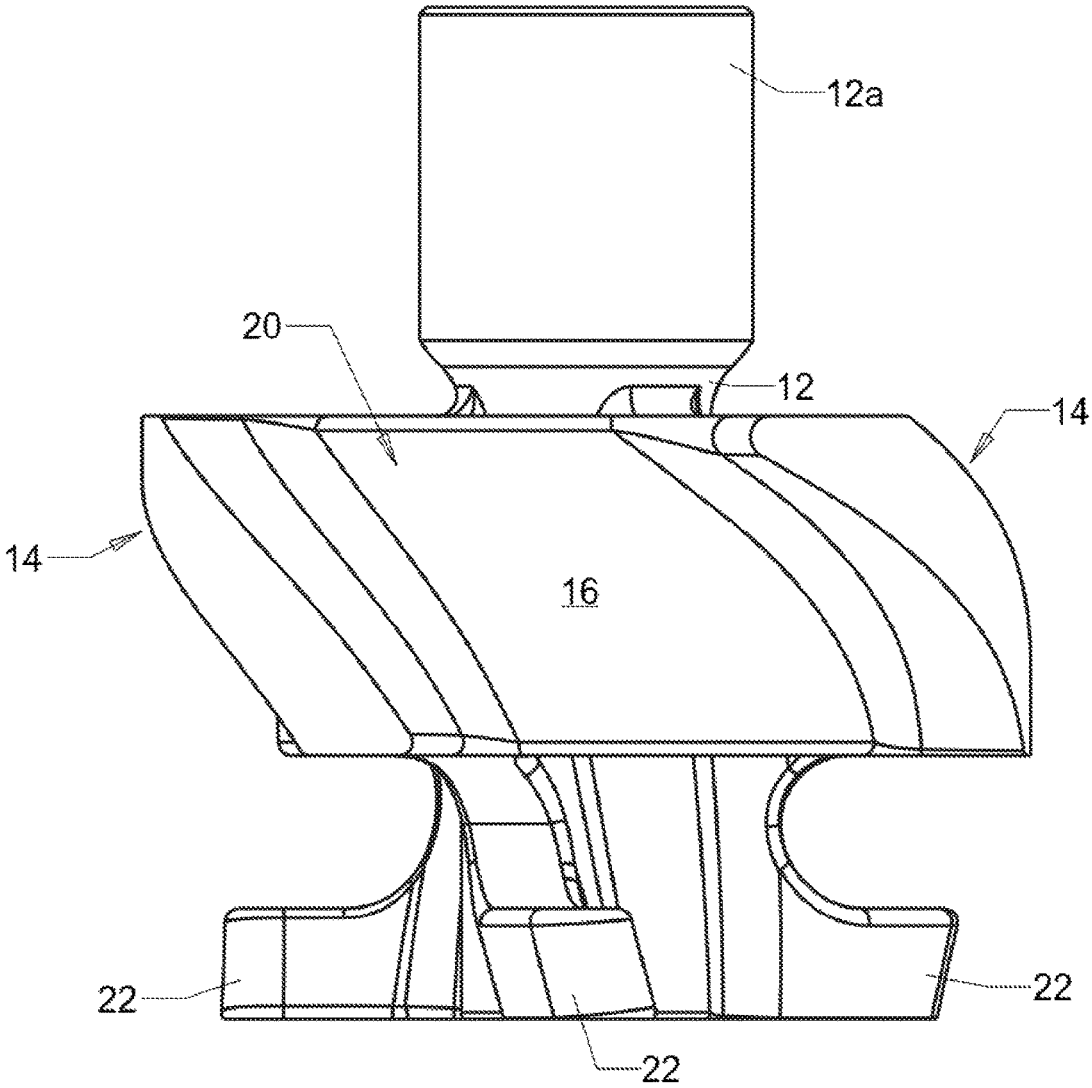
FIG. 5 is a further side elevation view of the agitator of FIG. 1.

Each one of the vanes 14 has a length L, as best understood by viewing FIG. 4, which is substantially parallel to axis A, a thickness t1 (see in FIGS. 1 and 4), an internal depth d1 (best seen in FIG. 7) of the inner vanes extending between the hub 12 and the shroud 16, and an external depth d2 (FIG. 7) of the outer vanes extending from the shroud 16 to the side surface 14*a* of vane 14. Each of the vanes 14 extends radially outwardly of axis A, with the depth dimensions d1 and d2 of vanes 14 being substantially perpendicular to axis A.

A cylindrical shroud 16 encircles the central shaft 12 so as to intersect the vanes 14 substantially halfway along their depth, illustrated as at the intersection of depths d1 and d2. Shroud 16 also intersects vanes 14 along their length L, so as to define inner passageways 18 between vanes 14, shroud 16, and central shaft 12, and so as to also define outer passageways 20 between the vanes 14 and extending radially outwardly of axis A and shroud 16. The vanes 14 may be helically curved relative to the central axis A in a direction facing or leading in the direction of rotation B.

In the illustrated embodiment, not intended to be limiting, vanes 14 all have substantially the same inner and outer depths "d1" and "d2", respectively, and the same length L and thickness t1, and the same curvature profile (angles $\alpha$1 and $\alpha$2). The shroud 16 is advantageously mounted to the vanes 14 at substantially halfway of the overall depth of the vanes 14, so that depth d1 may be for example, substantially equal to depth d2.

Figure 6:
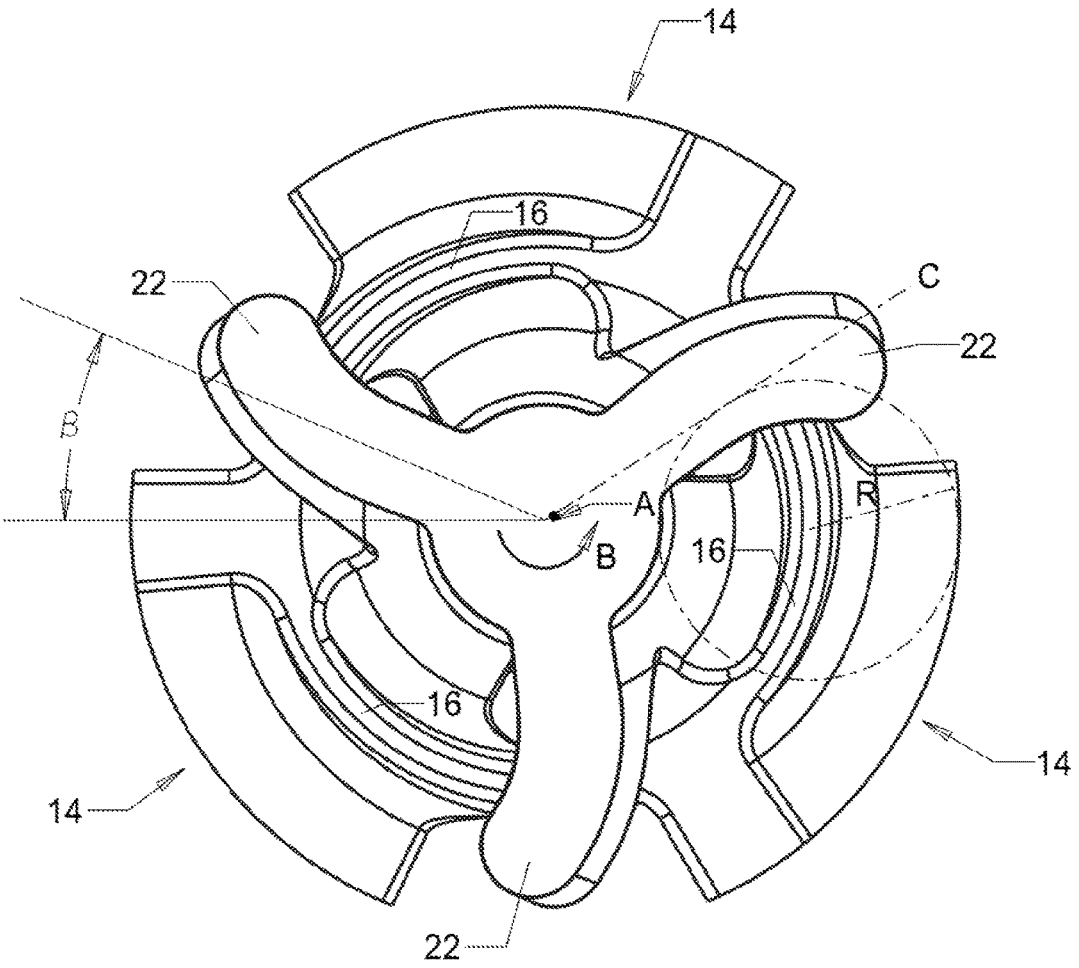
FIG. 6 is a bottom elevation view of the agitator of FIG. 1.

A radially spaced array of mixer arms 22 extend radially outwardly of axis A and central shaft 12. The mixer arms 22 lie substantially in a plane orthogonal to axis A and are spaced vertically from vanes 14 and shroud 16. Thus, the plane containing mixer arms 22 is spaced apart along axis A from the lower end of the radially spaced array of vanes 14. The mixer arms 22 may be somewhat curved in a scimitar shape, when viewed, for example, from the bottom of the agitator as seen in FIG. 6. Mixer arms 22 are mounted to a lower extension of central shaft 12.

Figure 7:
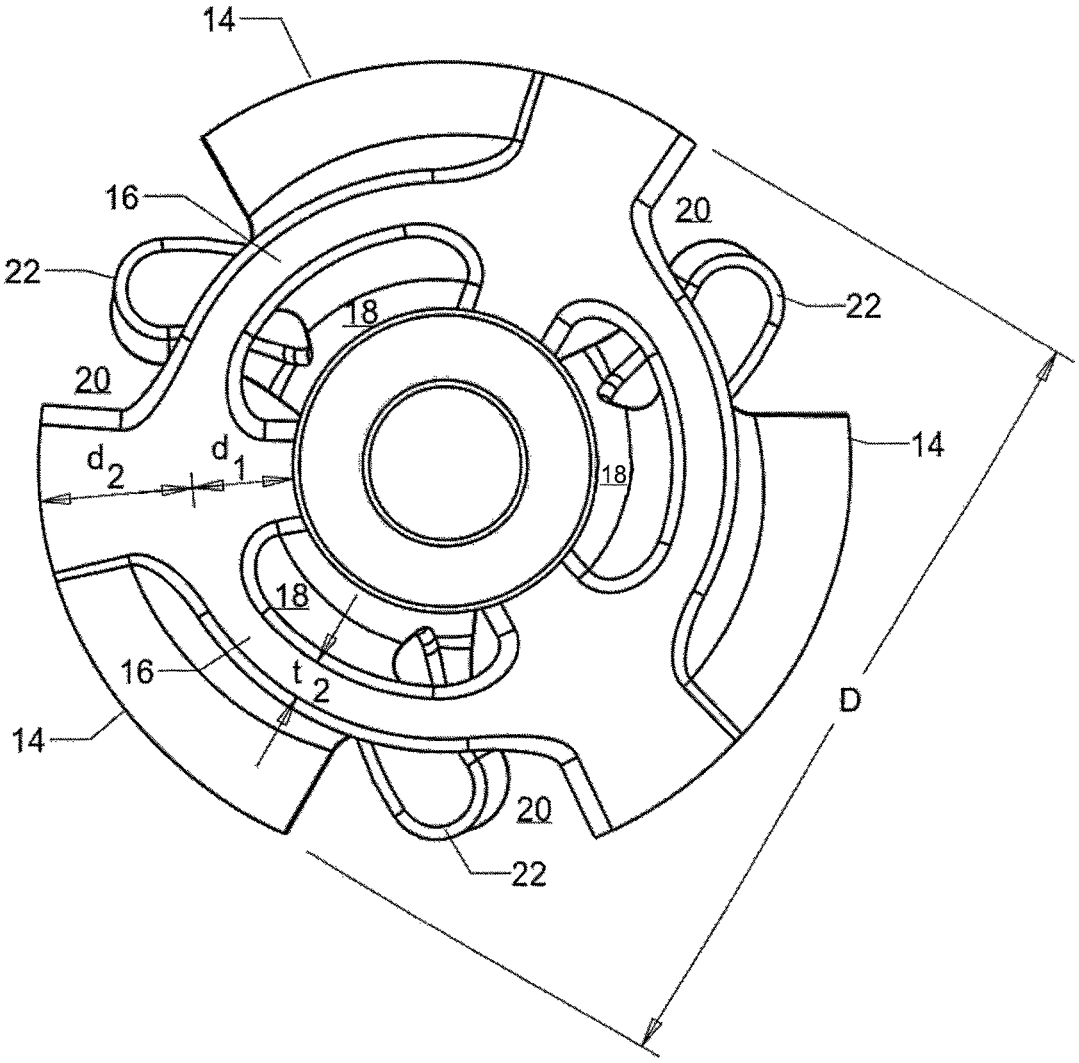
FIG. 7 is a top elevation view of the agitator of FIG. 1.
Figure 8:
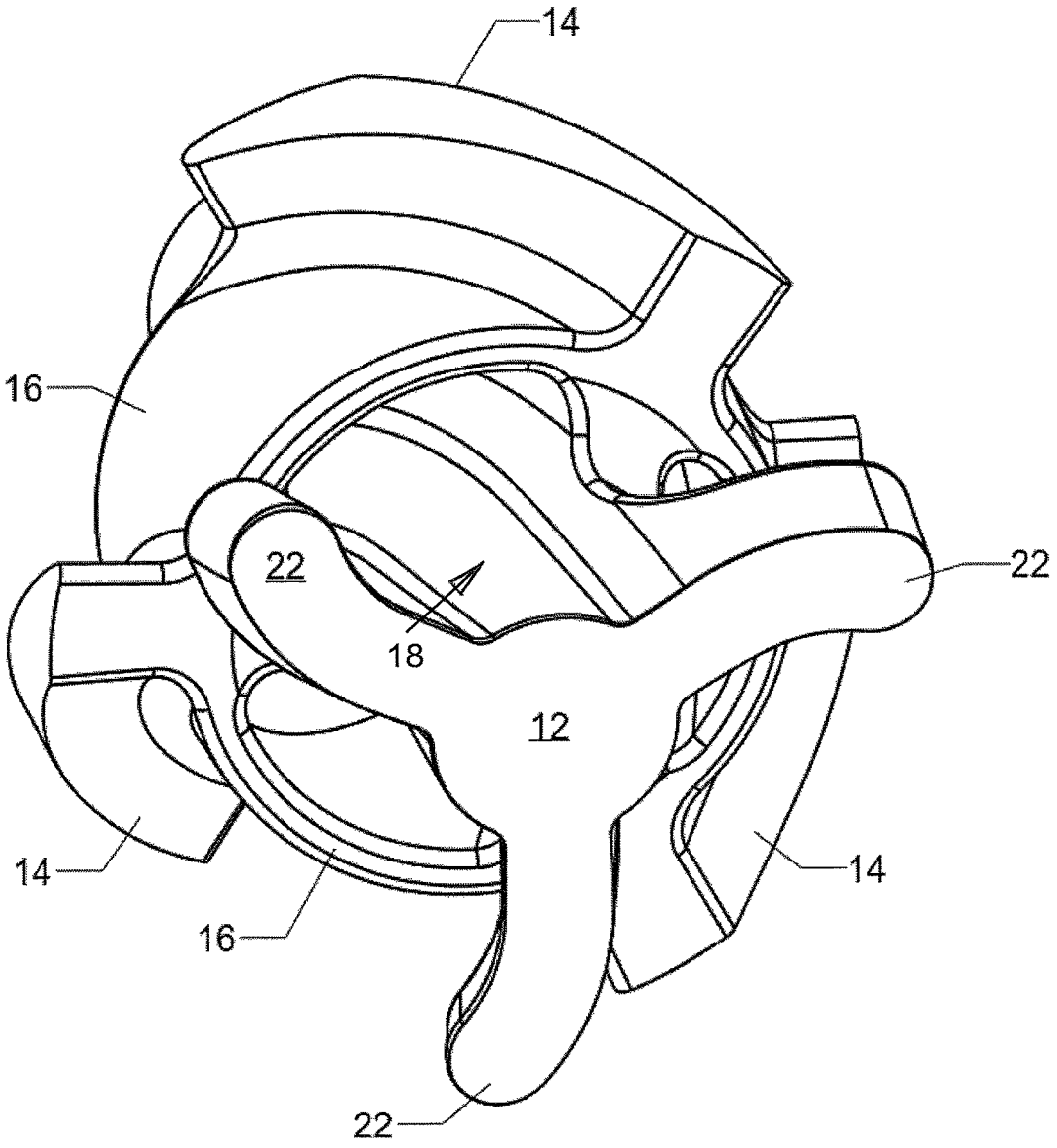
FIG. 8 is a further bottom perspective view of the agitator of FIG. 1.

The shroud 16 has a thickness t2, best seen in FIG. 7. Thickness t2 may be in the range of substantially 5% to 10% of the agitator blade diameter D, and preferably, the average shroud thickness is approximately 7% of the overall blade diameter D (across the blades of the agitator), as measured from the side surfaces 14*a* of the vanes 14. In an embodiment, the diameter D may range, for example, from approximately 125 mm to 305 mm. This example of the range of diameters D across vanes 14 for various sizes of agitators in accordance with this disclosure is in no way intended to be limiting, and it will be understood by a person skilled in the art that agitators of smaller or larger diameters D than the range stated above may be desirable for various different applications and fall within the scope of this disclosure.

Central shaft 12 may include a shaft coupler 12*a* at its upper end so as to couple agitator 10 to the drive shaft of the impeller (not shown). Coupler 12*a* may for example provide for a splined mounting onto a lower end of the impeller drive shaft. As used herein, the mixer arms 22 are at the lower end of the agitator, and the coupler 12*a* is at the upper end of the agitator.

Advantageously, the vanes 14 in the array of vanes are substantially equally radially spaced apart; that is, equally spaced apart about axis A.

The shapes of the various components of the agitator were optimized by experimentation utilizing computational fluid dynamics software to test various designs. The results of experimentation impacted the design of, for example, the hub, the blades or vanes, the shroud, and the mixer arms. Thus it was found that a vertically straight-sided hub was an optimized design, although other designs would work, albeit sub-optimally, such as using a hub that was wider (had a greater diameter) at the top and was narrower at the bottom. Simulation indicated that tapering the hub did not give any benefit to the agitator. Other hub shapes which were experimented with, for example, shapes where the hub narrowed at the top and widened at the bottom, or curved between the top and bottom. However, these various designs were found to be either sub-optimal in performance as compared to a straight-sided hub, or showed negligible improvement to the agitator's performance.

Similarly, the radial blade shape, which refers to the shape of the blades when viewed from the side as in FIG. 4, was experimented with. Like the hub, it was found that the side surfaces 14*a* of the vanes (the radially outermost surfaces) were best kept vertically straight so as to be parallel to the outermost surfaces of the hub 12. No significant advantage was found in varying the radial blade shape, for example, by flaring side surfaces 14*a* outwardly relative to the hub so that the upper ends 14*b* of the blades extended further out from the hub than did the lower ends 14*c*.

Observations made during simulations also determined that agitator designs utilizing three blades 14 are optimal. It was found that three blades provided significantly more agitation than two blades. However, rotating an agitator with three blades requires more power than rotating an agitator with two blades. On the other hand, agitator designs using four blades seem to provide somewhat better agitation than a three blade design, but the slight increase in agitation performance did not offset the drawback of the increase in the power draw required to rotate a four bladed agitator in slurry. Further, it was determined that using four blades would place the blades too close together for optimized agitation of slurry. With the relatively thick blades required for slurry agitators, the surfaces of the blades would be so close together, especially near the hub, that the inner open channel area or passageway 18 between the blades 14, through which solids must be capable of passing, would be too constrained. Furthermore, employing four blades and a corresponding shroud so as to enclose the inner portions of the blades would almost fully close off the inner passageways 18 between the hub and shroud, especially with smaller-sized agitators, inhibiting most solids from passing through and thereby rendering the inner passageways 18 almost useless. Consequently, the trade-off of using three blades was deemed to be the optimal configuration for agitation performance and the power required to drive the agitator. However, it is noted that four blades could be utilized in some embodiments and should be considered within the scope of the present disclosure, especially for larger agitators provided with sufficient rotational power to drive the agitator.

The blade shape was also optimized by experimentation. The blade profile is defined with reference to angle $\alpha$, illustrated as including angles $\alpha$1 and $\alpha$2 in FIG. 4. Angle $\alpha$ refers to the curvature of the blade's curved surface 14*f* relative to the horizontal. It was found that optimal agitation performance balanced with power draw requirements occurs where the angle $\alpha$ increases from $\alpha$1, which is proximate the leading edge 14*d*, to $\alpha$2, which is proximate the trailing edge 14*e*. It was observed by the applicant that, as the blade becomes steeper, so as to be closer to vertical (in other words, where angle $\alpha$2, shown in FIG. 4, approaches 90 degrees), the power draw required to rotate the agitator in a slurry increases. Based on simulations using a straight blade, where angle $\alpha$ remained constant, the performance improved up to a certain point as the blade angle $\alpha$ increased, after which the performance began to worsen. The angle $\alpha$, measured at a radial depth d1 of the blade 14, substantially proximate the shroud 16, was thus optimized wherein $\alpha$1 is less than 35 degrees and $\alpha$2 is greater than 35 degrees, with the numerical average of $\alpha$1 and $\alpha$2 being substantially equal to approximately 35 degrees. Furthermore, the numerical average of $\alpha$1 and $\alpha$2 decreases as the blade depth (d1, d2) increases, such that the average of $\alpha$1 and $\alpha$2 is greater than 35 degrees proximate the hub 12, and the average of $\alpha$1 and $\alpha$2 is less than 35 degrees proximate the side surface 14*a* of a blade 14.

In addition, it was determined that blades 14 with no sweep provided the best balance between performance and power draw. Forward sweep blades 14 were generally found to increase the power draw of the agitator with negligible gains in performance, whereas reverse sweep blades were found to have decreased performance (though slight improvements with respect to requiring lower power draw). Furthermore, forward sweep blades 14 were found to cause difficulties when encountering solids in slurry, as the forward sweep blades would experience higher erosion on the leading edge 14*d* relative to the rest of the blade profile, whereas erosion is more evenly distributed across the entire blade 14 in blades with no sweep.

Blade thickness was chosen based on blade wear in slurry agitation. Thick blades are required to prevent wear or possible breaking of the blades 14, as the blades contact solids within the slurry. In an embodiment, the blades 14 have a thickness t1 of approximately 10% to 15% of the diameter D across the blades 14 of the agitator. Preferably, the blades 14 have a thickness t1 of substantially 12.5% of the diameter D across the blades 14 of the agitator.

The set-down distance S is the distance between the mixer arms 22 and the agitator blades 14, as best seen in FIGS. 1 and 4. Distance S is such that the mixer arms 22 will not inhibit the primary downward flow of the slurry in direction E. Mixer arms 22 are close enough to blades 14 and mounted to the hub 12 so as to be structurally strong and to reduce the risk of the mixer arms breaking off from the agitator hub 12. The optimal positioning of the arms 22 about axis A in terms of the trade-off between performance and power draw was found to be a substantially equal distribution of the three mixer arms 22 radially spaced apart about axis A, and further, to radially offset the mixer arms 22 relative to the blades 14 by an angle $\beta$ of substantially 23 degrees, as best seen in FIG. 6. However, it will be understood by a person skilled in the art that other angles $\beta$ may be selected and still remain within the scope of the present disclosure. The shape and curvature of the mixer arms 22 was selected so as to reduce the power draw while still providing good horizontal flow outwards (substantially in direction E', as best seen in FIG. 4) for the mixing. Thus, the mixer arms are reverse swept so that the blades curve backwards with respect to the rotation direction B as the radial distance from axis A increases, as seen in FIG. 6. Furthermore, the curvature of the mixer arms 22, defined along a longitudinal axis C extending from the axis of rotation A of the agitator and passing through the lateral center of the blade of the mixing arm 22, has an approximate radius of curvature R, best seen in FIG. 6 by way of example, equal to approximately 50% of the diameter D of the agitator blades 14.

The shroud 16 serves several purposes. Firstly, it increases overall strength of the agitator. The shroud 16 increases overall strength as would a wider hub. It allows the hub 12 to be smaller in diameter and the blades of larger depth d1, d2. Without the shroud 16, either the blades 14 would need to be of smaller depth d1, d2, or the hub 12 would require a larger diameter to sufficiently reduce the risk of the blades breaking from impact of larger solid materials in the slurry.

Secondly, as mentioned above, the shroud improves wear characteristics of the agitator by inhibiting wear of the inner blades with a depth d1. Physical tests using an agitator 10 designed in accordance with this disclosure in slurry showed that the outer blades wore out the most rapidly while the shroud also began to wear quite significantly in-between the blades 14. However, the inner blades (corresponding to d1) experienced very little wear and continued to provide agitation when the outer blades (corresponding to d2) were almost completely worn off. Therefore, it has been observed the shroud 16 will wear down significantly before the inner blades wear away, increasing the length of service of the agitator 10 before replacement is required.

It was also observed that the shroud 16 wears out first at the top. Therefore, the thickness t2 of the shroud 16 is greater near the top 16*a* of the shroud and slightly lesser near the bottom 16*b*, and tapers in between, since the extra thickness is not required at the bottom and the thinner portion 16*b* of the shroud 16 provides slightly greater blade surface area for agitation.

Thirdly, the shroud 16 helps maintain downwards flow (generally in direction E) as opposed to radially outwards flow relative to axis A (generally in direction E') as the slurry flows downwards. The shroud 16 generally assists in redirecting the flow of the slurry substantially in direction E as opposed to direction E' along the length of the agitator. Thus, the radially outward flow of the slurry in direction E' is delayed, so that it will not start flowing radially outwards until the slurry flow has exited the enclosed inner passageways 18 defined between the blades 14 and the shroud 16.

The scope of the described disclosure is intended to include all embodiments coming within the meaning of the following claims. The foregoing examples illustrate useful forms of the disclosure, but are not to be considered as limiting its scope, as those skilled in the art will be aware that additional variants and modifications of the disclosure can readily be formulated without departing from the meaning of the following claims.

What is claimed is:

1. An agitator comprising:

a central shaft extending along an axis of symmetry and rotation, a radially spaced array of vanes, radially spaced around the central shaft, each of the vanes of the radially spaced array of vanes having a length substantially parallel to the axis and a depth substantially perpendicular to the axis, each of the vanes extending radially outwardly of the axis, a shroud encircling the central shaft so as to intersect the vanes perpendicular to their depth and along their length so as to define inner passageways between the shroud and the central shaft and outer passageways between the vanes radially outwardly of the shroud.

2. The agitator of claim 1 wherein each vane in the array of vanes has substantially the same depth, and wherein the shroud intersects the vanes at substantially halfway of the depth of the vanes.

3. The agitator of claim 1 further comprising a radially spaced array of mixer arms extending radially outwardly of the central shaft and mounted to the central shaft spaced apart from the radially spaced array of vanes along the central axis.

4. The agitator of claim 3 wherein the array of mixer arms are radially offset from the array of vanes.

5. The agitator of claim 3 wherein the mixer arms lie substantially in a plane orthogonal to the central axis.

6. The agitator of claim 5 wherein the mixer arms are curved in a scimitar-shape.

7. The agitator of claim 3 wherein each mixer arm of the array of mixer arms has a reverse sweep.

8. The agitator of claim 1 wherein the vanes are helical relative to the central axis.

9. The agitator of claim 1 wherein the agitator further comprises a diameter measured by a radially outer edge of each vane of the array of vanes and wherein the shroud has an average thickness of approximately 7% of the diameter.

10. The agitator of claim 1 wherein the central shaft includes a coupling end and the shroud includes a top end proximate the coupling end of the central shaft and a bottom end opposite the top end, wherein a thickness of the shroud tapers from the top end to the bottom end.

11. The agitator of claim 1 wherein each vane in the array of vanes are substantially equally radially spaced apart.

12. The agitator of claim 11 wherein the array of vanes has three vanes.

13. The agitator of claim 1 wherein each vane of the array of vanes has no sweep.

14. The agitator of claim 1 wherein the agitator further comprises a diameter measured by a radially outer edge of each vane of the array of vanes and wherein each vane has a thickness of approximately 12.5% of the diameter.

* * * * *